US006319148B1

(12) United States Patent
Tom

(10) Patent No.: US 6,319,148 B1
(45) Date of Patent: Nov. 20, 2001

(54) SELF-ALIGNING, MINIMAL SELF-TORQUE GOLF CLUBS

(76) Inventor: Leung Tom, 52 North Ridge Road, Iie Bizard, Quebec (CA), H9E 1A6

( * ) Notice: Subject to any disclaimer, the term of this patent is extended or adjusted under 35 U.S.C. 154(b) by 0 days.

(21) Appl. No.: 09/165,337

(22) Filed: Oct. 2, 1998

(30) Foreign Application Priority Data

Sep. 15, 1998 (CA) ..... 2246965

(51) Int. Cl.[7] ..... A63B 53/04

(52) U.S. Cl. ..... 473/290; 473/314; 473/324; 473/327; 473/328; 473/331; 473/345; 473/349

(58) Field of Search ..... 473/314, 305, 473/327, 328, 324, 330, 331, 345, 290

(56) References Cited

U.S. PATENT DOCUMENTS

| | | | | |
|---|---|---|---|---|
| D. 246,865 | * | 1/1978 | Krysakowski | 473/328 |
| 2,088,095 | * | 7/1937 | Sargent | 473/314 |
| 2,661,952 | | 12/1953 | Jackson . | |
| 2,683,036 | | 7/1954 | Klein . | |
| 2,926,913 | | 3/1960 | Stecher . | |
| 3,081,087 | | 3/1963 | Redd . | |
| 3,368,812 | | 2/1968 | Baldwin . | |
| 3,468,544 | | 9/1969 | Antonious . | |
| 3,595,577 | | 7/1971 | Hodge . | |
| 3,637,218 | | 1/1972 | Carlino . | |
| 3,693,978 | | 9/1972 | East . | |
| 3,817,534 | | 6/1974 | Carlino . | |
| 3,860,244 | | 1/1975 | Cosby . | |
| 3,888,484 | | 6/1975 | Zitco . | |
| 3,941,390 | | 3/1976 | Hussey . | |
| 3,954,265 | | 5/1976 | Taylor . | |
| 3,997,170 | * | 12/1976 | Goldberg | 473/327 |
| 4,065,133 | | 12/1977 | Gordos . | |
| 4,195,842 | * | 4/1980 | Coleman . | |
| 4,432,549 | | 2/1984 | Zebelean . | |
| 4,900,029 | * | 2/1990 | Sinclair | 473/327 |
| 4,930,783 | * | 6/1990 | Antonious | 473/242 |
| 5,000,454 | | 3/1991 | Soda . | |
| 5,080,365 | | 1/1992 | Winchell . | |
| 5,094,457 | | 3/1992 | Kinoshita . | |
| 5,193,810 | | 3/1993 | Antonious . | |
| 5,199,707 | | 4/1993 | Knox . | |
| 5,344,141 | * | 9/1994 | Smith . | |
| 5,397,126 | | 3/1995 | Allen . | |

(List continued on next page.)

FOREIGN PATENT DOCUMENTS 2147304 10/1996 (CA) .

*Primary Examiner*—Jeanette Chapman
*Assistant Examiner*—Stephen L. Blau
(74) *Attorney, Agent, or Firm*—Jones, Tullar, Cooper, P.C.

(57) ABSTRACT

A self-aligning, low or no self-torque club that is both statically- and dynamically-balanced is provided which is less prone to deleterious effects during its approach to and while striking the ball Static balance is achieved by ensuing the shaft axis intersects the line between the geometric center of the club face and the center of gravity of the club head. The club is self-aligning because the center of gravity naturally follows the shaft and since the shaft and center of gravity are in-line with the face center, the possibility of striking the ball with the club face square increases. By providing a symmetrical and, preferably elliptical face, forces due to air resistance act equally on both sides of the face with respect to the shaft further aligning the club face with the swing path. To further alignment, the club head may also be provided with a series of convergent channels in the direction of air flow over the club. The channels stabilize the club head during downswing and move the center of pressure toward the rear of the club and, preferably, in-line with the center of gravity and the club face. The symmetry of the club head permits, in one embodiment, the same club head to be used for right- or left-handed golfers. Also provided is a set of clubs according to the invention, which due to their similar static and dynamic balance and similar shape and configuration, provide a similar feel and play throughout the entire range of lofts.

65 Claims, 7 Drawing Sheets

U.S. PATENT DOCUMENTS

| | | | | |
|---|---|---|---|---|
| 5,405,136 | * | 4/1995 | Hardman | 473/342 |
| 5,423,546 | | 6/1995 | Manning et al. . | |
| 5,435,558 | | 7/1995 | Iriarte . | |
| 5,451,056 | | 9/1995 | Manning . | |
| 5,470,070 | | 11/1995 | Bendo . | |
| 5,497,992 | | 3/1996 | Ritke . | |
| 5,501,459 | | 3/1996 | Endo . | |
| 5,505,448 | | 4/1996 | Park . | |
| 5,505,450 | | 4/1996 | Stuff . | |
| 5,509,659 | | 4/1996 | Igarashi . | |
| 5,547,188 | * | 8/1996 | Dumonitier | 473/287 |
| 5,551,786 | | 9/1996 | Webster . | |
| 5,749,793 | * | 5/1998 | Lucetti . | |
| 5,928,088 | * | 7/1999 | Matthews | 473/313 |

* cited by examiner

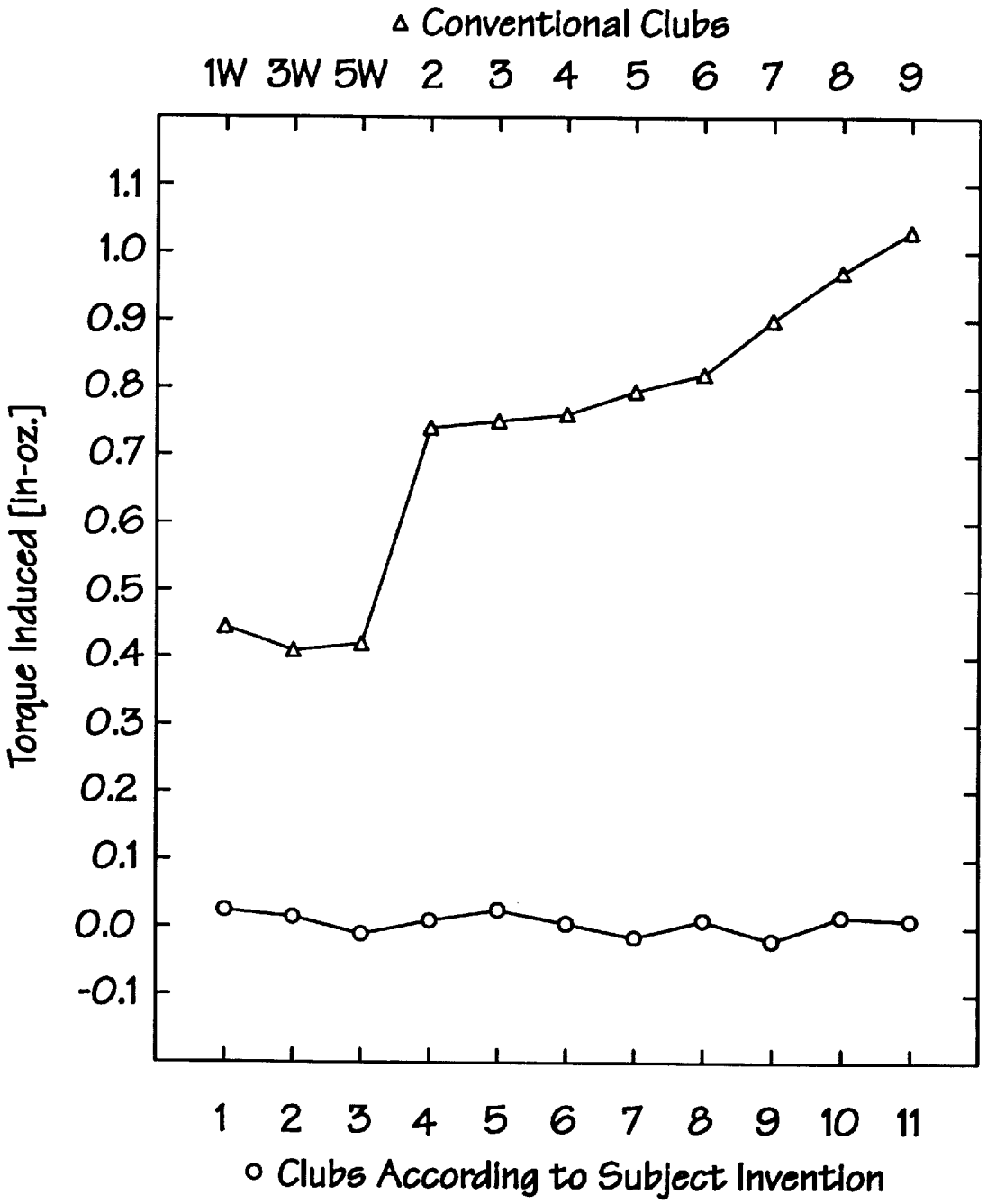
Fig. 9 STATIC STATE SELF-INDUCED TORQUE

SELF-ALIGNING, MINIMAL SELF-TORQUE GOLF CLUBS

FIELD OF THE INVENTION

The invention relates to golf clubs and, more particularly, the invention concerns the provision of a better engineered golf club which is less prone to deleterious effects during its approach to and in the course of striking the ball.

BACKGROUND

The problem with conventional golf clubs and particularly but not necessarily limited to non-putting type clubs, is that they are not well-designed from an engineering standpoint. This is primarily due to the fact that golfers governing bodies place restrictions and/or limitations on all aspects of the club design since their mandate is to preserve the game of golf rather than to perfect it. The most serious drawback concerns the restriction that the shaft must be connected to the club head at or near the heel of the club head. Since the majority of the mass of the club head and, hence, the center of gravity, is offset from the point of application of the swing force, i.e. the shaft connection, when the club is swung, inertia and air resistance acting on the club will tend to cause a rotation of the club head about the shaft, a phenomenon which will be referred to herein as "self-torque". This rotation of the club head and, hence, the club face (being "opens", causes the ball to leave the club face not at a right angle to the swing path. Not only does the golfer have to ensure an accurate swing path, but he must also compensate for self-torque induced problems. To complicate matters, the different clubs in a set of conventional clubs have offsets of different magnitudes, making it more difficult to adjust from club to club. In order to reduce the amount of self-torque, manufacturers are forced to provide shafts of higher torsional stiffness and, hence, of generally greater weight which, for a given club weight, will result in less weight available for selective use in the club head where the weight is most needed. A further drawback is that the ratio of width to length of the club head is required to be one or more, i.e. the club head must be wider than it is long.

The offset of the center of gravity from the shaft axis also causes problems with respect to the lie of the club. During downswing, the centrifugal force acting through the center of gravity of the club head, causes the shaft to bend downward, resulting in a one or two degree change in the lie of the club, as shown in FIG. 2, depending on the shaft flex and head speed. This happens because the center of mass or center of gravity of the club head is not in line with the centerline of the shaft in the swing plane.

Yet another drawback to conventional clubs is that, due to their design, almost the entirety of material devoted to the club head goes into ensuring the head is of sufficient strength to resist the impact of the ball, leaving precious little material for strategic placement or specialty weighting purposes. Where a larger club face or "sweet-spot" on the club face is desired, even more of the material must be devoted for structural purposes. If the overall weight of the structural material in the club head could be reduced, more weight would be available for selective disposition. Any such weight which can be freed-up, described hereinafter as "free available weight", could be used at the discretion of the manufacturer, for example, to increase the size of the sweet spot and/or the size of the club face, to compensate for habitual slices or hooks and high or low flight paths, and to provide custom clubs with a precise loft and lie to match individual needs.

It would, therefore, be greatly beneficial to have a golf club which practically eliminates this problem of self-torque. By ensuring the center of gravity is generally in-line with the shaft in the swing direction, inertia-induced self-torque can be mire. To most golfers, this would serve to reduce the number of errant shots. To the manufacturer, this would permit less torsionally rigid and, hence, lighter shafts to be used, thereby affording more free available weight for exploitation and, ultimately, an even better club for golfers. Since all clubs of the set could be designed similarly, there would be no requirement for the golfer to make adjustments from club to club to compensate for the differences in self-torque as is the case with a set of conventional clubs.

To further assist the golfer, it would be advantageous to provide a golf club which assists in self-aligning with the trajectory of the swing path to further ensure the club face remains substantially perpendicular ("square") at the point of contact.

It would also be beneficial to maximize the ball contact area of the club while maintaining the same frontal area (or air resistance) of the club head as conventional clubs. Conventional clubs have a frontal area which is significantly greater than the area of the hitting face and considerably greater than the area of the sweet-spot. For example, conventional clubs typically provide a substantially-sized hosel connecting the club head to the shaft which not only consumes club head material, resulting in less free available weight, but which also increases the frontal area of the club, and which increased frontal area is not useful hitting surface. It would, therefore, be advantageous to have a club head in which all of the frontal area of the club serves as the club face. In addition, it has been determined through research that the distribution of contact locations of the ball on the club face over a number of hits is roughly elliptical about the center of the club face. It would, therefore, be beneficial to provide a club face which reflects this type of distribution such that practically the entire club face is useful, hitable surface.

Lastly, in order to further assist the golfer, it is desired to provide a club which could compensate for striking the ball off-center with respect to the face of the club.

SUMMARY OF THE INVENTION AND OBJECTS

In general, it is an object of this invention to provide a low or no self-torque club whose principles of construction can be applied to all clubs, i.e. both the "wood-type" clubs and the so-called "irons".

It is a further object of this invention to provide a golf club which is self-aligning during the swing to increase the possibility of striking the ball with the club face square.

It is yet another object of this invention to maximize the ball contact area of the club while maintaining the same frontal area as conventional clubs and further to not have any wasted frontal area.

Another object of this invention is to reduce significantly the structural weight of the club head to thereby increase the "free available weight"; and to use the freed-up weight to enlarge the sweet spot, to increase the effect of self-alignment, and for selective disposition in custom made clubs.

It is a further object to maximize the radius of gyration of the club by having optimal weight distribution in the club head itself.

It is also an object of the invention to reduce the weight needed for attachment of the shaft to the club head thereby increasing the free available weight for selective disposition, and further to reduce air resistance by having a minimal attachment diameter.

It is yet another object of this invention to provide a groove pattern which maximizes the gear effect to compensate for mis-hit balls.

It is also an object to reduce the torsional stiffness requirements of the shaft.

A still further object of the invention is to provide a club whose lie does not change during downswing.

In general, some or all of the foregoing objects are achieved in a self-aligning, low or no self-torque club that is both statically and dynamically balanced. By utilizing precise weight distribution and modern manufacturing techniques, as well as precise location of the club components, a substantially perfect, if not perfect, static balance can be achieved. Perfect static balance is the key to the development of a dynamically balanced club. A better dynamic balance is achieved through static balance by ensuring the center of gravity of the club head is positioned directly behind and in-line with the location of force application to the club head, i.e. the shaft connection, and in-line with the center of the club face. In other words, the longitudinal axis of the shaft intersects the line between the geometric center of the club face and the center of gravity of the club head. Stated alternately, the shaft axis, the geometric center of the club face and the center of gravity lie in the same plane which plane is, in essence, the swing plane of the golf club. In such an arrangement, the club, when balanced horizontally on its shaft with its face upward, will remain in that position because its center of gravity is vertically in-line with the shaft axis and the club face. With a conventional club having a center of gravity generally behind the face but with both the face and center of gravity being transversely offset from the shaft axis, the club face will rotate until the center of gravity is vertically in-line with the shaft but at which position the face is facing a generally near-horizontal direction. In other words, it can be said that conventional clubs are statically unstable with respect to their club faces.

By placing the center of gravity a predetermined distance behind the shaft with respect to the club face and, in general, as far behind the shaft as the construction solidity (structural integrity) of the club head permits, the center of gravity will tend to follow the shaft, i.e. self-align, thereby ensuring the club face is square at the point of impact with the ball. Since there is no offset between the club face, shaft connection and center of gravity, there is no self-torque generated during the downswing. Since the center of gravity is located as far as practically possible from the point of application of the swing force, i.e. the shaft, the moment of inertia of the club head is maximized, thus, minimizing the tendency of the club face to rotate upon impact when the ball is hit off-center.

As mentioned above, this propensity for low or no self-torque permits the use of less torsionally rigid shafts. Not only is a less torsionally rigid shaft typically lighter, permitting the difference in weight to be distributed to the club head, but it will also have the tendency to allow the center of gravity to more readily follow the shaft during the swing, thereby compensating for deviations in the golfer's wrist positions at the point of contact. In addition, since a relatively torsionally stiff shaft is not required, the shaft could be provided with a non-circular cross-section to reduce further the air resistance and, more importantly, to permit the shaft to be designed for a specific purpose, such as, for example: to reduce air resistance/drag; to store additional downswing energy to be released at impact; and through the use of asymmetrical designs, to further reduce shaft weight, etc.

The self-aligning quality of the club may be further improved through aerodynamic design. By providing a symmetrical face, forces due to air resistance act equally on both sides of the face with respect to the shaft further aligning the club face with the swing path of the club head. The club head may also be provided with a series of convergent longitudinal channels in the direction of club swing to further align the club head. The channels serve to stabilize the club head during downswing and move the center of pressure toward the rear of the club and as far behind the axis of the shaft as possible and, preferably, in-line with the center of gravity and the club face.

To help the ball go straighter, grooves can be provided on the club face which correspond with the elliptical shape of the face. It has been found that similarly elliptical grooves on the club face maximize the gear effect and, thereby, will tend to compensate for mis-hit shots. The gear effect is a result of friction between the curved surface of the ball and the curved surface of the convex club face. When the ball is hit on the club face off center, the impact causes the club head to rotate and, hence, causes the curved surface of the club face to act like a gear against the compressed ball, which acts as the other gear, imparting an opposite (and corrective) rotation to the ball. By providing generally concentric elliptical grooves on the club face, wherever the ball is hit off-center, the segments of the grooves at the point of impact will be aligned for maximize friction and, therefore, maximum gear effect.

These and other objects, advantages and features of the present invention will be described hereinbelow in detail with respect to the accompanying drawings in which:

BRIEF DESCRIPTION OF THE DRAWINGS

FIG. 9 is a comparative chart showing the static state self-induced torque of a conventional set of golf clubs versus a set of golf clubs in accordance with the invention;

FIG. 10A is an rear elevational view showing the inside of the club face section;

FIG. 10B is a side elevational view; and

FIG. 10C is a rear perspective view;

FIG. 11A is an rear elevational view showing the inside of this club face section;

FIG. 11B is a side elevational view; and

FIG. 11C is a rear perspective view; and

DETAILED DESCRIPTION OF THE INVENTION

Figure 1A:
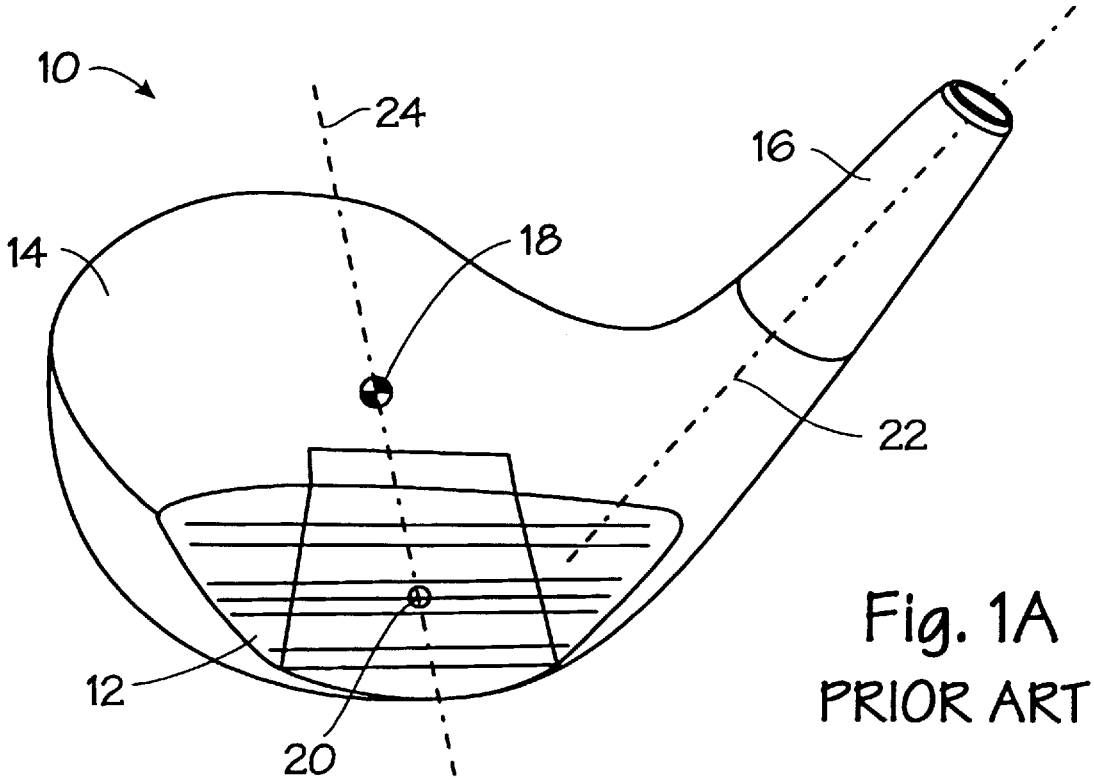
Fig. 1A PRIOR ART
FIGS. 1A and 1B are perspective and front elevational views, respectively, of the club head of a conventional wood-type golf club.
Figure 1B:
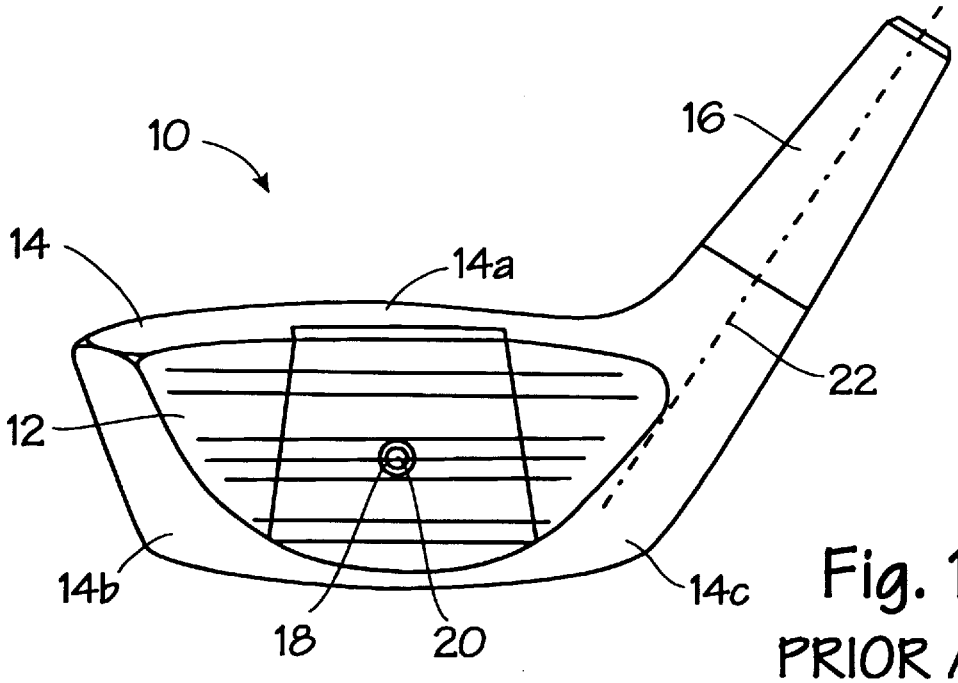
Fig. 1B PRIOR ART
Figure 2:
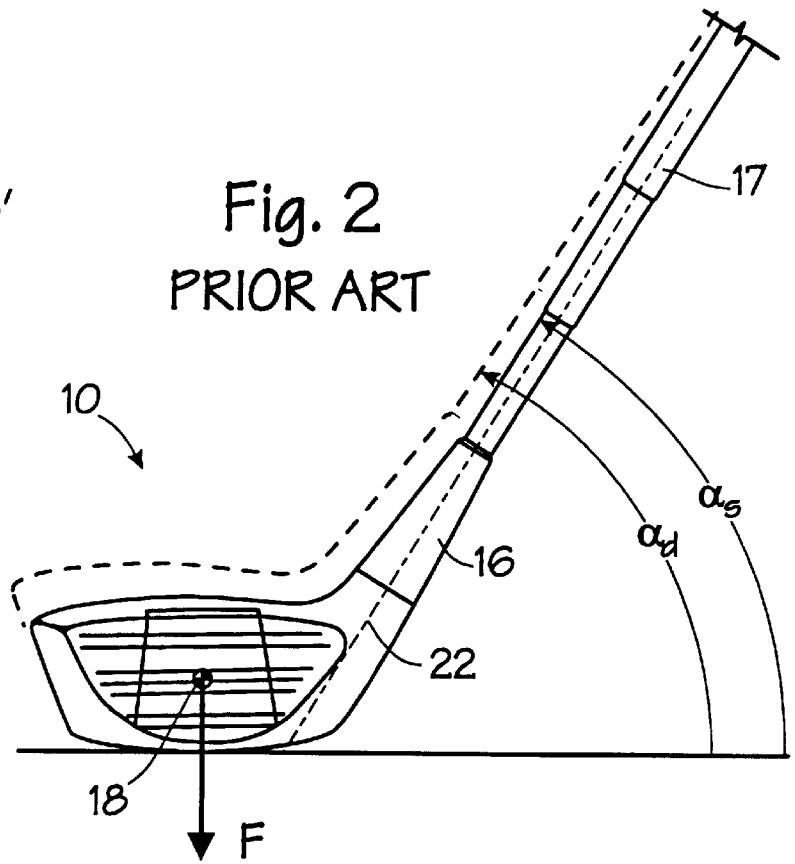
Fig. 2 PRIOR ART
FIG. 2 is a front view of a conventional wood-type golf club showing the manner in which the club head lie changes during the swing.
Figure 1C:
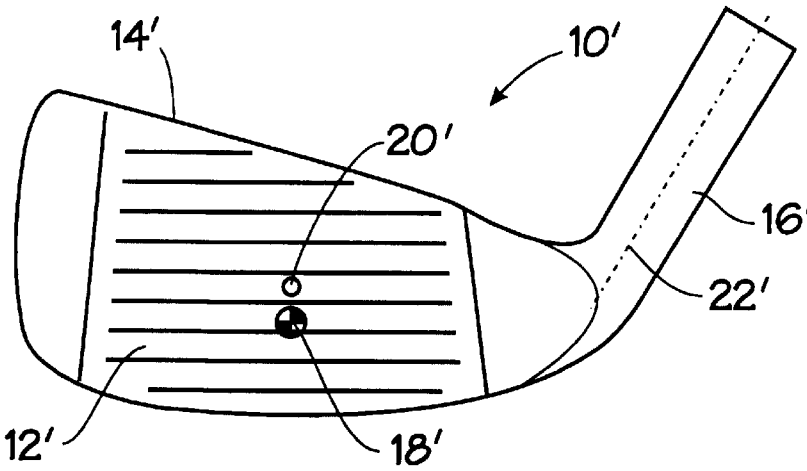
Fig. 1C PRIOR ART
FIGS. 1C and 1D are front elevational and plan views, respectively, of the club head of a conventional iron-type golf club.
Figure 1D:
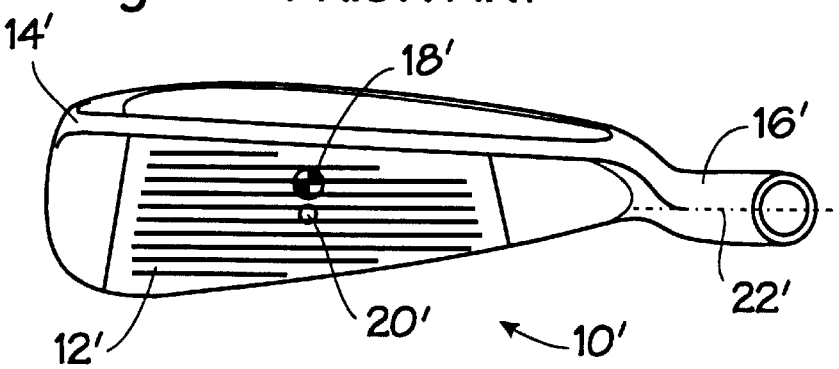
Fig. 1D PRIOR ART

A conventional wood-type club head 10, which could be made of metal, is shown in FIGS. 1A, 1B and 2 having a club face 12, a body 14, and a hosel 16 for connecting the shaft 17, shown only partially in FIG. 2, to the club head. The conventional club head 10 has a center of gravity 18 disposed generally in-line behind the club face center 20. Since the shaft axis 22 (or an extension thereof) does not intersect the line 24 between the club face center 20 and the center of gravity 18, the acceleration during downswing causes the club head 10 to rotate about the shaft axis 22, thereby giving rise to a tendency to have the club face 12 open at contact unless the golfer can provide the precise amount of compensation therefor. Similarly, a conventional iron-type club head 10' is illustrated in FIGS. 1C and 1D having a club face 12', a body 14', and a hosel 16' for connecting the shaft (not shown) to the club head 10'. As with the wood-type conventional clubs, the center of gravity 18' is displaced from the centerline 22' of the shaft and it may be in line with or below the center 20' of the face 12', thereby also causing the club head 10' to rotate about the shaft axis 22' during downswing. For illustrative purposes, the center of gravity 20 of the wood-type club 10, while shown in FIG. 1B to be in the same horizontal plane as the geometric center 20 of the club face 12, is not necessarily so positioned. It is typical, however, for the center of gravity 20 to lie in the same vertical plane as the geometric center 20, which plane is generally perpendicular to the club face 12, such as is illustrated with respect to the iron-type club shown in FIG. 1D. Likewise, the center of gravity 18' of the iron-type club 10', while typically positioned below the center of face 12', it may also lie in the same horizontal plane thereas.

FIG. 1B shows the frontal area of a conventional wood-type club 10 with respect to the swing direction. As can be seen, the frontal area includes not only the club face 12, but also the hosel 16 and portions 14*a*, 14*b* and 14*c* of the body 14. The frontal area which is not the club face 12 is not useful hitable surface and adds to the air resistance of the club head 10. With the iron-type clubs 10' (FIGS. 1C and 1D), while a greater portion of the club face 12' is hitable surface area, the hosel 16' still adds to the non-useful frontal area of the club and it may interfere with shots hit at or near the heel of the club.

As shown in FIG. 2, the offset of the center of gravity 18 from the shaft axis 22 also causes the normal or static lie $\alpha_s$ of the club to change during downswing to a different lie $\alpha_d$. In other words, the club's dynamic lie $\alpha_d$ (at the point of impact with the ball) is different than its static lie $\alpha_s$. The downward component of the centrifugal force F acts through the center of gravity 18 of the club head 10, causing the shaft 17 to bend downward, resulting in a one or two degree change in the lie $\alpha_d$, depending on the shaft flex and head speed, as compared with its static lie $\alpha_s$. This is because the center of mass or center of gravity 18 of the club head is not in line with the centerline or axis 22 of the shaft 17 in the swing plane. Since the center of gravity 18' of the iron-type club head 10' is also spaced from the centerline or axis 22' of its shaft, the lie of iron-type clubs during downswing is similarly affected. This can be problematic since it is the static lie $\alpha_s$ of the club upon which the lie of the club is determined for the specific golfer when the clubs are purchased, particularly with custom clubs.

Figure 3A:
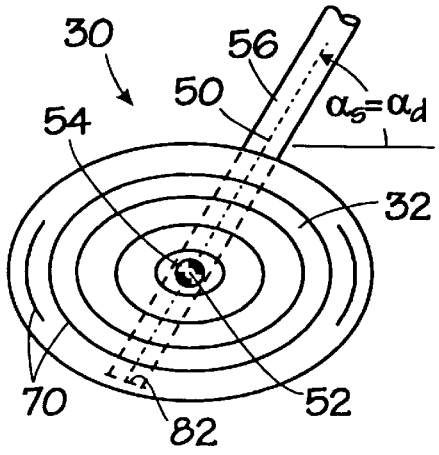
FIG. 3A is a front elevational view of a golf club head in accordance with the present invention.
Figure 4A:
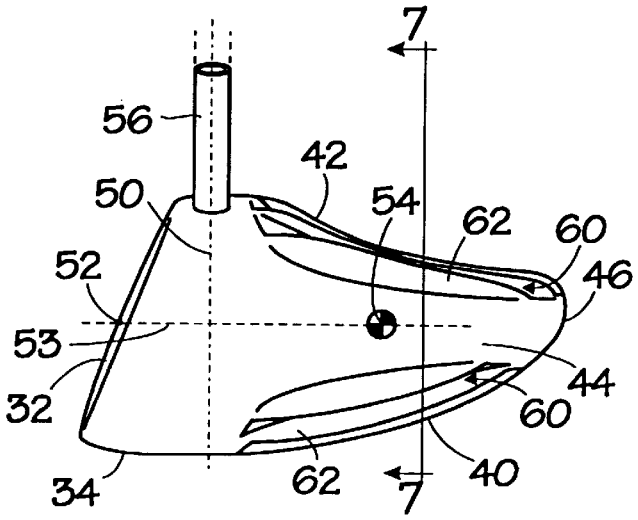
FIG. 4A is a side elevational view of the golf club head of FIG. 3A.
Figure 7:
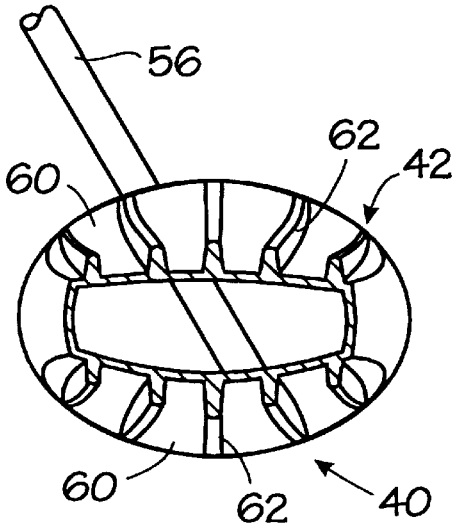
FIG. 7, is a cross-sectional view of the golf club head shown along lines 7—7 in FIG. 4A.
Figure 8:
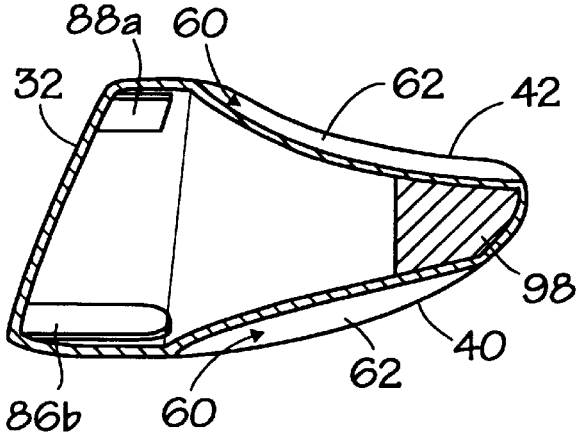
FIG. 8, is a cross-sectional view of the golf club head shown along lines 8—8 in FIG. 5.

A club head according to the present invention is designated generally at 30 in FIGS. 3A, 4A and 5 to 8. The club head 30 has a generally elliptical club face 32 which constitutes substantially the entire frontal area in the swing direction as can be seen in the front view of FIG. 3A. The club face 32 has a slightly convex surface which facilitates the gear effect upon contact with the ball. The club head body 34 extends rearwardly from the club face 32 in a forward portion 36 of generally the same outer dimension as the elliptical club face 32 to a rear body portion 38 which has a lower surface 40, an upper surface 42 and side surfaces 44 all of which generally converge to terminate in a rounded tail 46. The club head 30 is generally longitudinally symmetrical about a vertical plane which passes through the center 52 of the club face 32. The golf club shaft 56, shown in FIGS. 3A, 4A and 7, is inserted through an aperture 48 and secured therein as will be explained in greater detail hereinbelow. The aperture 48 is positioned such that the shaft axis 50 lies between the geometric center 52 of the club face 32 and the center of gravity 54 of the club head 30. In other words, the shaft axis 50, or an extension thereof, intersects the imaginary line 53 drawn between the face center 52 and the center of gravity 54. Such an arrangement results in a statically-balanced club. The expression "statically-balanced" as used herein generally means that, the club, when balanced horizontally on its shaft with its face upward, will remain in that position because its center of gravity is vertically in-line with the shaft axis and the club face. In the case of a conventional wood-type club 10 having a center of gravity 18 generally behind the center 20 of the face 12 but with both the face center 20 and center of gravity 18 being transversely offset from the shaft axis 22 (see FIGS. 1A and 1B), the club face 12 will rotate in such a static-balance test until the center of gravity 18 is vertically in-line with the shaft axis 22 but at which position the face 12 will be facing a generally near-horizontal direction. In the case of a conventional iron-type club 10' having a center of gravity 18' transversely offset from the shaft axis 22' (see FIGS. 1C and 1D), the club face 12' will also rotate in such a static-balance test until the center of gravity 18' is vertically in-fine with the shaft axis 22' but at which position the face 12' will be also be facing a generally near-horizontal direction. The propensity of a club to move from its statically unstable position to a statically-stable positioned can be easily measured by placing the shaft horizontally in a torsion measuring apparatus with the face of the club head facing generally upwards. Any horizontal offset between the centerline of the shaft and the center of gravity will result in a torsional moment applied to the shaft This torsional moment is referred to herein as the "self-induced" torque of the golf club. FIG. 9 compares this self-induced torque at static state of conventional golf clubs and a set of golf clubs in accordance with the present invention. As can be seen, amount of self-induced torque in the golf clubs of the present invention is nominal, particularly with respect to the self-induced torque of the conventional club set. The variations (from zero) in the self-induced torque of the golf clubs of the present invention are primarily due to manufacturing tolerances. With tighter tolerances, the self-induced torque should approach zero.

Figure 3B:
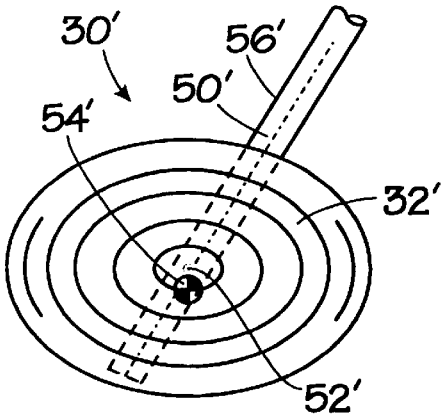
FIG. 3B is a front view of a golf club head according to the invention having a lower center of gravity than the club of FIG. 3A.
Figure 4B:
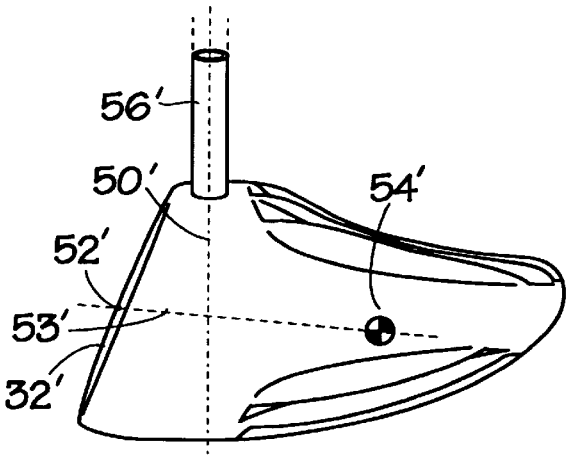
FIG. 4B is a plan view of a club head of FIG. 3B.
Figure 5:
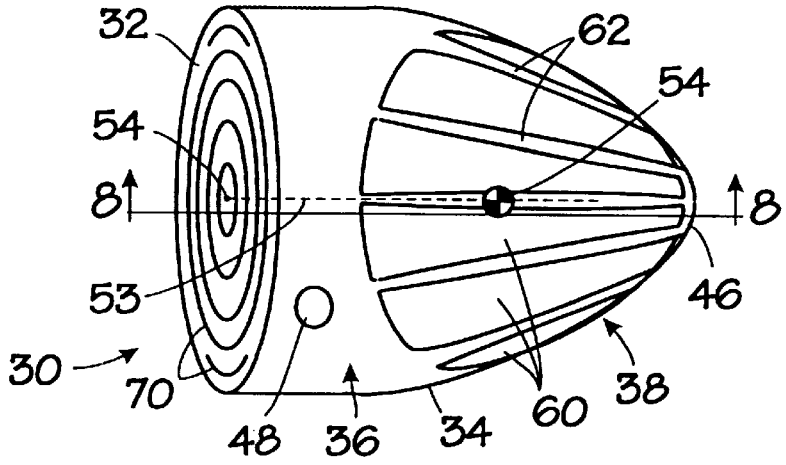
FIG. 5 is a plan view of a golf club head of FIG. 3A, shown without the shaft section for greater clarity.
Figure 6:
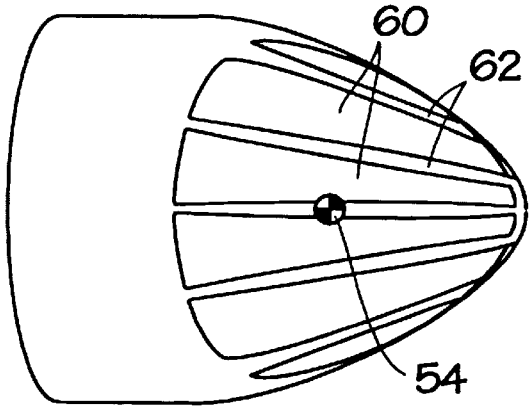
FIG. 6 is a bottom view of the golf club head of FIG. 3A.

In FIGS. 3A and 4A, the club head 30 is shown having its center of gravity 54 positioned in the same horizontal plane as the face center 52 (by "horizontal plane", it is meant a plane which is generally parallel to the plane of the ground when the club head is aligned in its ball-address position). However, it will be appreciated that the center of gravity can be positioned slightly above or below and/or to the left or right of the face center, while still enabling the shaft to be positioned such that its axis intersects the imaginary line between the face center and the center of gravity. FIGS. 3B and 4B illustrate this point. In this case, the center of gravity 54' of club head 30', is positioned horizontally below the geometric center 52'. Because the imaginary line 53' angles slightly downwardly from the face center 52' to the center of gravity 54', the position of the shaft 56' must be varied slightly (as shown by comparison of FIGS. 3A and 3B), to have the shaft axis 50' intersect the line 53' in accordance with the invention. The amount of offset of the shaft axis 50' relative to the club face 32' will be a function of the distance of the shaft axis 56' to the face center 52', the distance the center of gravity 54' from the face center 52' and the amount of deviation of the center of gravity 54'. However, since the club of the present invention preferably has its center of gravity disposed as far back as possible from the club face and has its shaft positioned more closely to the club face than to the center of gravity, the amount of the offset will be minimal, given the limited deviation available for the positioning of the center of gravity.

Not only does having the shaft axis positioned between the geometric center of the club face and the center of gravity result in a statically balance club, but it also contributes to the dynamic balance of the club. Such an arrangement ensures the center of gravity will follow the shaft during the swing and, thereby, increase the probability that the club face will be square to the ball upon impact. Additionally, the position of the shaft, in conjunction with the shape of the club face, ensures generally equal frontal areas on either side of the shaft axis upon which air resistance forces will act equally, serving to further self-align the club head during the downswing, hence better dynamic balance. With the club configuration shown in FIG. 3A, wherein the center of gravity 54 is positioned directly behind the face center 52 in the same horizontal plane, it can be seen that equal frontal areas of the club face 32 are disposed on either side of the shaft 56. Accordingly, air resistance forces apply equally on both sides. In the case of the lower center of gravity club 30' shown in FIG. 3B, it will be appreciated that the slight offset of the shaft 50' with respect to the club face 52' will not result in a such a difference in the areas of the club face 32 on either side of the shaft 56' that the air resistance forces win act significantly out of balance.

It should also be pointed out that, since the center of gravity 54 is in line with the shaft axis 50, the dynamic lie angle $\alpha_d$ will remain the same as the static lie angle $\alpha_s$, i.e. the lie does not change depending on whether the club head 30 is at rest or in motion during a swing.

Since the club face 32 constitutes the entirety of the frontal area of the club head 30 during the swing, for a given frontal area, a larger club face 32 can be provided as compared with the club face 12 of a conventional wood-type club.

To give the club head 30 an even greater propensity to self-align, the body 34 may be provided with a plurality of channels 60 which are arranged generally lengthwise in the direction of air flow over the body 34 during the swing (see FIGS. 4A and 5 to 8). In the preferred embodiment, a plurality of channels 60 are disposed in both the lower and upper surfaces 40,42 of the rear body portion 38. The channels 60 may be disposed sufficiently close together such that the material between adjacent channels 60 forms a sort of rib or fin 62 (see FIG. 8) which, due to the shape of the rear body portion 38 and the position of the channels 60, are also generally aligned with the flow of air over the club head 30 during the swing. These ribs 62 act like the flight of a dart and assist in keeping the club face 32 aligned squarely during the downswing. More importantly, however, each channel 60 of the present invention, while being generally open, preferably converges toward the rear of the club head 30. These convergent channels 60 serve to move the center of pressure of the club head 30 during the swing more rearwardly of the club face 32. The shape of the rear body portion 38 and the shape of the channels 60 are preferably designed to ensure the center of pressure is substantially in-line with the geometric center 52 of the club face 32 and the center of gravity 54 of the club head 30. In this regard, it can be seen that the set of channels on the upper surface 42 converge toward the set of channels on the lower surface 40 and the channels of each set converge toward one other toward the rear 46 of the club body 34.

In the preferred embodiment, the shape of rear body portion 38 is such that it does not extend outward of the club face 32 as seen in the direction of swing (see FIG. 3A or 7), so as not to provide any non-useful (non-hitable) frontal area. In the embodiment illustrated in FIGS. 3A, 4A and 5 to 8, the lower surface 40 of the rear body portion 38 is convex in both the transverse direction, as seen in FIG. 7, and the longitudinal direction, as shown in FIG. 4A, while the upper surface 42 is transversely convex (FIG. 7) but longitudinally concave (FIG. 4A). The longitudinally convex shape of the lower surface 40 prevents the club head 30 from digging into the ground, while the longitudinally concave upper surface 42 provides a kind of spoiler effect to the air moving thereover, thereby minimizing drag.

As indicated above, the club face 32 is provided with a slight convex surface to induce the gear effect with off-centered hits. To augment the gear effect, a plurality of generally concentric, elliptical grooves 70 are provided in the club face 32 so that wherever the ball is hit off-center of the club face, the portion of these grooves at the point of contact will be substantially transverse to the corrective spin direction imparted to the ball thereby increasing the friction at that point and, hence, increasing the amount of corrective gear effect spin imparted to the ball. Since the portions of the grooves 70 above and below the geometric center 52 of the club face 32 are generally horizontal, they will tend to impart substantially the same action to the ball as the horizontal grooves disposed in conventional club faces 12 when the ball is hit generally in these same locations.

Figure 10A:
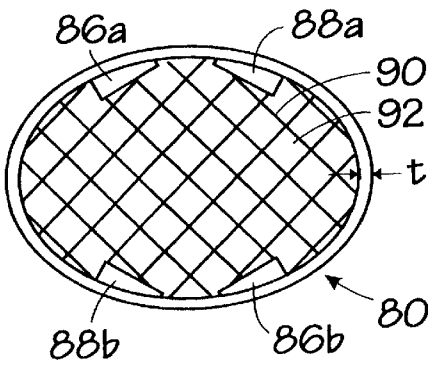
FIGS. 10A–10C show one embodiment of the club face section of the club head according to the invention showing the shaft connection arrangement.
Figure 10B:
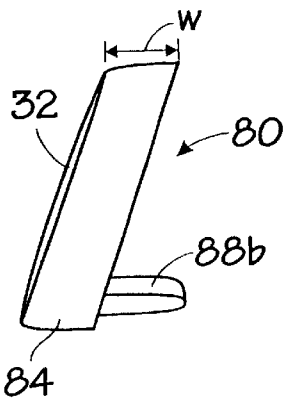
Figure 10C:
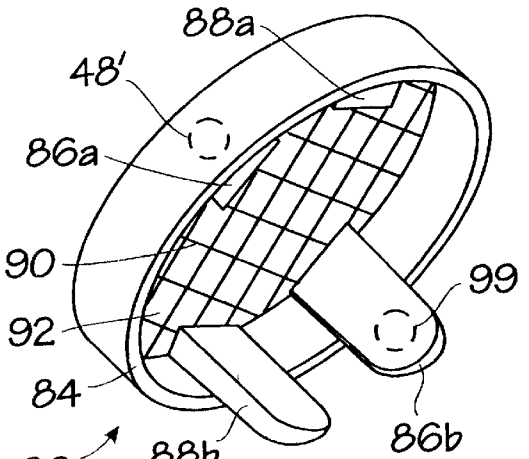

The preferred face section 80, illustrated in FIGS. 10A–10C, is connected/fused/welded to the body section(s) at or about the forward body portion 36 of the club head 30, as will be described in more detail hereinbelow. This enables a similar rear body portion 38 design to be used for practically the entire set of clubs ("woods" and "irons") merely by changing the angle at which the club face section is attached. The face section 80 has a rearwardly extending flange 84 (FIGS. 10B–10C), having an overall elliptical cross-section commensurate with the outer dimension of the club face 32.

Figure 12A:
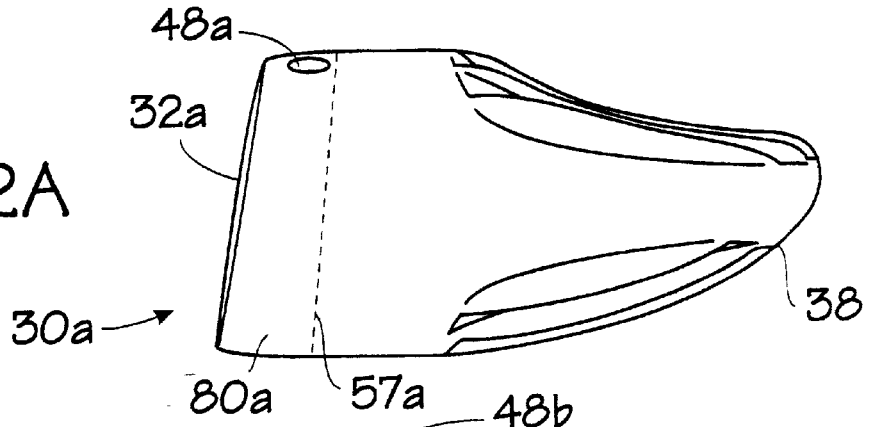
FIGS. 12A–12D are side elevational views of a select number of golf club heads of a set of golf clubs according to the present invention.
Figure 12B:
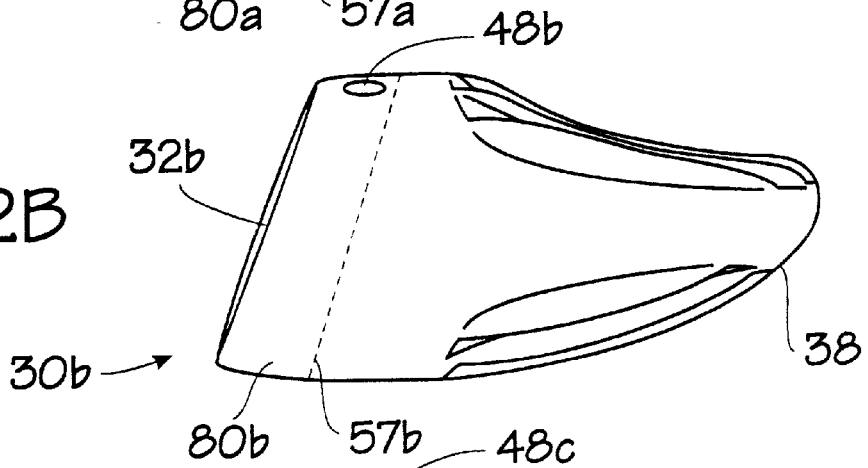
Figure 12C:
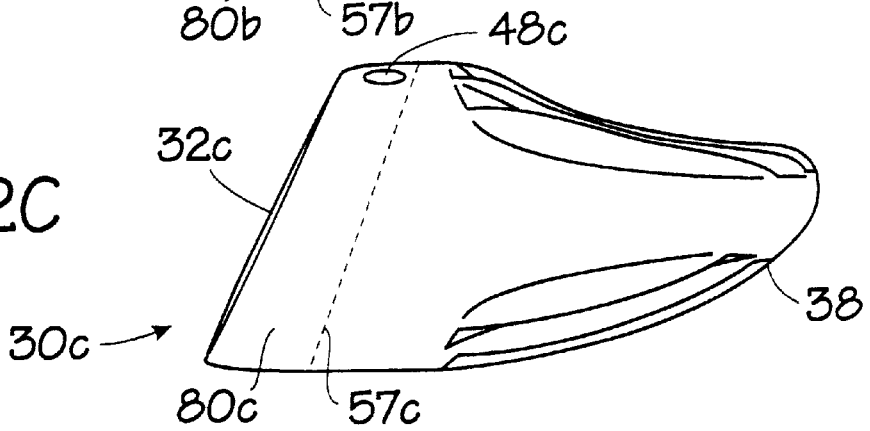
Figure 12D:
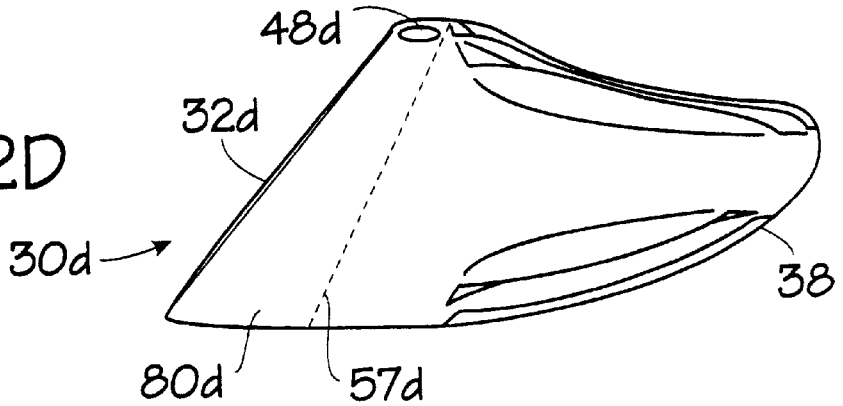

Variation of the thickness t of the flange 84 permits variable perimeter weighting about the club face. The shape of the flange and/or the angle by which it extends from said club face generally dictates the loft of the club when attached to the body portion. Depending on the loft of the club for which a specific club face 80 is intended, the width w of the flange 84 can be equal over its perimeter, as shown in FIG. 10B, or it can vary from top to bottom as is the case with the high lofted clubs, such as is shown in FIG. 12D.

The flange 84 includes at least one pair of diametrically-opposed tabs 86*a,*86*b* which are used to support the shaft of the club. The upper tab 86*a* provides a built-up area for accommodation of the aperture 48 through which the shaft 56 is connected to the golf head 34. The lower tab 86*b* extends rearwardly of the face 32 to provide an abutment 82 for the end of the shaft 56 (see FIG. 3A). The tabs 86*a,*86*b* are positioned to enable the shaft 56 to be oriented at the necessary angles to provide the appropriate lie for the intended club.

Preferably, the tabs 86*a,*86*b* are sufficiently large such that there is room for minor variations in the loft and lie of individual club heads by varying the angle through which the aperture can be drilled. It will be appreciated that a jig could readily be used to precisely drill the holes at the desired angles. Taking advantage of the symmetrical nature of the club face, the face section 80 may be provided with a second pair of diametrically opposed tabs 88*a,*88*b* to enable the same club face section 80, and hence the same club head 34, to be used for either left-handed and right-handed golfers. As mentioned above, tabs 88*a,*88*b* are sized and positioned to permit minor variations in attachment angle during the shaft connection process to accommodate various lie and offset angle requirements in so-called customized clubs. A plurality of reinforcing ribs 90 may be provided on the inner or rear surface 92 of the club face for strengthening purposes. The ribs 90, which may be of triangular or other appropriate cross-section, extend from the rear surface 92 in a series of diagonals to form a waffle-like pattern.

Figure 11A:
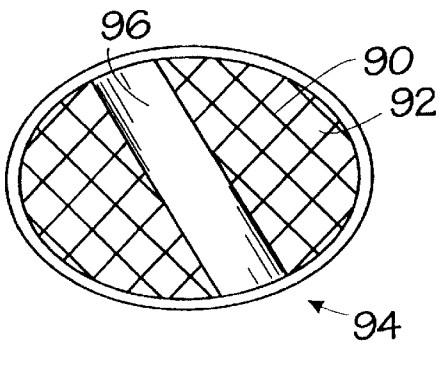
FIGS. 11A–11C show another embodiment of the club face section of the club head according to the invention showing an alternate shaft connection arrangement.
Figure 11B:
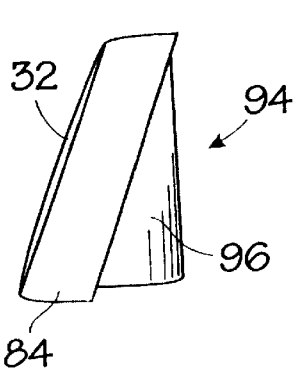
Figure 11C:
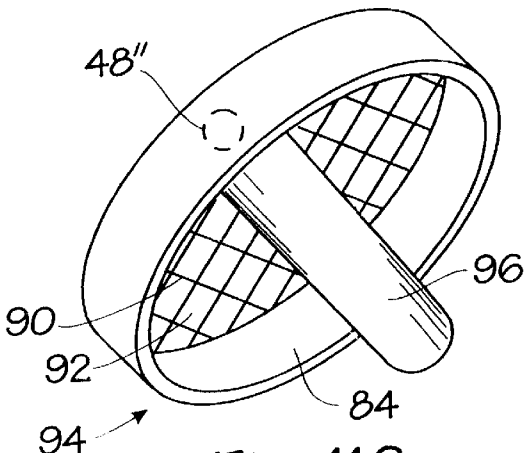

FIGS. 11A–11C shows an alternate face section 94 having an initially solid, generally tubular shaft receiving element 96 diagonally abutting the inner surface 92 of the club face. This arrangement provides additional support to the club face. Additional strengthening may also be provided by way of ribs 90. The tubular element 96, like tabs 86*a,*86*b* or 88*a,*88*b,* is preferably sized and positioned for a particular loft in accordance with the loft on the face 32 and to enable minor variations therein where customization is desired.

Returning now to FIG. 8, the club head 30 is substantially hollow except for the shaft connection structure and the weighting structure, which is designated generally as 98. The weighting structure 98 is used to ensure precise static balance of the club and to move the club head's center of gravity as far back from the club face as practical. Preferably, any free available weight which is not devoted to the structural integrity of the club head or the shaft connection can be used to align and displace the center of gravity, which preferably, is displaced as far back from the club face 32, and hence, the shaft axis 56, as the structural integrity of the club head will allow. Since the length of the club head 30 (as shown from left to right in FIG. 4A) is preferably longer than the width of the club head 30 (as shown from left to right in FIG. 3A), it is possible to place the free available weight much farther back from the shaft axis 50 than in a conventional wood-type club 10, wherein the distance the center of gravity can be placed is limited due to the width to length ratio (>1) restriction voluntarily complied with by most manufacturers.

Without departing from the aforementioned engineering and design considerations for the clubs of the present invention, it is quite possible that even with such precisely balanced, self aligning clubs, the golfer may still not be able to strike the ball perfectly each time due to the human factor, i.e due to inconsistent swing path/plane, hand, foot and/or body position at time of contact, etc. However, habitually persistent problems such as slices or hooks and deleteriously high or low trajectories can readily be eliminated by altering slightly the position of the center of gravity to compensate for such problems, i.e. through "customization". Accordingly, the free available weight can be used to compensate for habitual hooking by positioning it more towards the toe of the club while placement more towards the heel would compensate for slicing. Concentrating more of the weight towards the sole results in a higher ball trajectory or compensation for low ball players. Lowering the weight also results in longer fairway shots. Conversely, positioning of the weight more towards the top of the club head provides compensation for high ball players and lowers the trajectory of the golf ball when struck. Maximization of the sweet spot can be accomplished by distribution of more of the free available weight about the periphery. However, most importantly is that the capability for self-alignment is maximized through positioning of the free available weight as far back from the shaft (and hence the club face) as possible. Additionally, the further the weight is placed away from the shaft, the greater the moment of inertia of the club head, thereby lessening the tendency of the club head to rotate upon impact with the ball when the contact is off center.

By virtue of the structural symmetry of the club head 30, the sweet spot will naturally be located at the center of the club face 52. With conventional, non-symmetrical club head design, the location of the sweet spot is not necessarily at the center of the club face.

The club can be manufactured using both conventional and non-conventional techniques in the field of club making, such as multi-piece investment casting and laser-welding connection techniques. Prototypes of the present invention have been made with a one-piece club face section and a one- or two-piece body. Preferably, the club faces 80,94 are cast from a high strength to weight ratio material to enable more weight to be dedicated as free available weight. The body may be made with ultra-strength, i.e. high strength to weight ratio, material and formed by a drawing technique which results in a very thin-walled, but high strength body section or formed by precision casting or stamping. Alternatively, the face sections 80,94 can be injection molded using high impact materials such as KEVLAR™ or graphite. Accordingly, it would be preferable in this case to injection mold the body section 38 and epoxy or otherwise adjoin the face section 80,94 thereto. The shaft 56 attachment to the face section 80,94 can be effected either prior to or preferably subsequent to adjoining the face section 80,94 and body section 38. In the case of face section 80, a hole or aperture 48 is drilled in the upper portion of flange 84 at the location 48' (shown in phantom in FIG. 10C) of upper tab 86*a* for right golfers or 88*a* for left golfers. The drilling may extend to respective lower tab 86*b* or 88*b* to provide a seat 99 (shown in phantom in FIG. 10C) therein for the better positioning of the tip of the shaft 56. In the case of face section 94, the aperture 48 is drilled in the upper portion of flange 84 at the location 48' (shown in phantom in FIG. 11C) and will extend a sufficient distance to permit the club shaft to be secured adequately therein. Depending on the position of the center of gravity 54 with respect to the face center 52, the drilling will have to be relatively precise in order to ensure the shaft axis 50 will be in line therebetween and in this regard, either a jig or use of computer-controlled machines can be used to locate precisely the appropriate aperture 48 and angle for the shaft 56. The shaft 56 is affixed through aperture 48 and between the tabs 86*a*,86*b* or 88*a*, 88*b* of face section 80 or within shaft receiving element 96 of a face section 94 by conventional methods such as by using epoxy or through electronic welding.

As indicated above, the principles of this invention can be incorporated into a series of clubs which constitute, for the most, part a "set" of clubs. FIGS. 12A–12D illustrate the Nos. 1, 5, 8 and 11 clubs 30*a*,30*b*,30*c*,30*d* of such a set in which there is no significant difference between the long and short shot clubs as is the case with a set of "woods" and "irons". As shown in FIG. 9, there is also a significant difference in the static state induced-torque in a conventional set of clubs, not only from club to club, but particularly between the "woods" and the "irons" categories of these clubs. Similarly, there are also significant differences in the dynamic-balance of conventional clubs due to differences in size and configuration. Together, this makes for a set of golf clubs which feel and play differently from one club to the next.

Since there is little or no induced-torque in the clubs of the present invention, and since they employ the dynamic-balancing principles of the present invention, the clubs tend to have an extremely similar feel and play when used. While the clubs shown in FIGS. 12A–12D all employ a similar rear body portion 38, as do all the clubs of this particular set to take advantage of economies of manufacture, it will be appreciated that the rear body sections 38 could be individually configured over the entire series and/or with respect to each loft of club to provide the golfer with a variety of purchasable selections for various conditions and manner of play. As shown in FIGS. 12A–12D, the loft of the club faces 32*a*,32*b*,32*c*,32*d* progressively increases from the No. 1 club 30*a* to the No. 11 club 30*d*. It may be desirable to utilize the free available weight to progressively lower the center of gravity slightly with each increase in loft. The body sections 38 are attached to the respective club face sections 80*a*,80*b*, 80*c*,80*d* as mentioned above, with lines 57*a*,57*b*,57*c*,57*d* generally showing the connection interface. Depending on the initial shape of the body section 38, machining or cutting operations may be required to increase or decrease the interface angle as the case may be to ensure a smooth interface between body section 38 and the respective club face sections 80*a*,80*b*,80*c*,80*d*.

While there has been described an illustrated herein preferred embodiments of the present invention, it will be understood that various modifications may be made thereto without departing from the spirit or scope of the appended claims. It will further be understood that the principles explained herein and, in particular, the concept of utilizing aerodynamics to move the center of pressure generally in line with the center of gravity and the center of the club face, may be applied to conventional clubs to provide self-aligning capabilities thereto.

I claim:

1. A golf club comprising:

a club head having:

an elliptical club face which constitutes the entire frontal area of the club head with respect to the swing direction, said club face being inclined at a predetermined loft angle;

a generally aerodynamic body extending rearwardly of said club face; and a center of gravity a predetermined distance behind said club face;

a shaft having a shaft axis, said shaft being disposed between the opposite side of the club face and the center of gravity with the shaft axis generally intersecting an imaginary line drawn between the geometric center of the club face and the center of gravity of the club head; and means for moving the center of pressure of the club head during travel of the club in the swing direction rearward of the club face and substantially in-line with the geometric center of the club face and the center of gravity of the club head, said means for moving the center of pressure of the club head comprising a plurality of channels disposed in said body and generally aligned with the direction of air flow over said body during travel of the club in the swing direction, each said channel converging toward the rear of the club head.

2. The golf club of claim 1, wherein said aerodynamic body comprises:

a forward portion extending rearwardly from said club face, said forward portion having substantially the same outer dimensions as the club face;

a rear portion extending rearward of said forward portion, said rear portion terminating in a rounded tail, said rear portion including a top surface, a bottom surface and side surfaces which converge to said rounded tail.

3. The golf club of claim 2, wherein the width of the club face is equal to or less than the length of the club head in the swing direction.

4. The golf club of claim 2, wherein the rear portion includes spoiler means for reducing air resistance during swing.

5. The golf club of claim 2, wherein said plurality of channels are provided in each said top and bottom surfaces.

6. The golf club of claim 5, wherein the plurality of channels on the top surface converges toward the plurality of channels on the bottom surface.

7. The golf club of claim 5, wherein the channels on the top surface converge toward one another and wherein the channels on the bottom surface converge toward one another.

8. The golf club of claim 2, wherein the bottom surface is longitudinally convex.

9. The golf club of claim 2, wherein the top surface is longitudinally concave.

10. The golf club of claim 1, wherein the center of gravity and the geometric center of the club face lie in a horizontal plane.

11. The golf club of claim 1, wherein the center of gravity is lower than the geometric center of the club face.

12. The golf club of claim 1, wherein a plurality of generally concentric, elliptical grooves are provided in said club face.

13. The golf club of claim 1, wherein an end portion of the shaft is disposed between a pair of diametrically opposed tabs extending from an inner side of said club face, said pair of tabs being positioned such that said shaft extends from said club head at a predetermined lie angle.

14. The golf club of claim 1, wherein two pairs of diametrically opposed tabs extend from an inner side of said club face, said shaft having an end portion disposed between the tabs of one of said pairs, said one of said pairs being selected according to whether a user of the golf club is a right-handed shooter or a left-handed shooter, each said pair of tabs being positioned such that said shaft will extend from said club head at a predetermined lie angle.

15. The golf club of claim 1, wherein the club head is longitudinally symmetrical about a vertical plane which extends though the geometric center of the club face.

16. The golf club of claim 1, wherein the shaft is disposed relative to the club face such that substantially equal areas of the club face extend on either side of the shaft.

17. The golf club of claim 1, wherein the shaft is disposed in a tubular shaft receiving member, said shaft receiving member diagonally abutting the inner side of said club face at an angle corresponding to a predetermined lie angle, said shaft receiving member underlying the geometric center of said club face.

18. The golf club of claim 1, wherein the hitting surface of the club face is slightly convex to facilitate the gear effect.

19. The golf club of claim 1, wherein said shaft axis intersects the imaginary line at a location farther from the center of gravity than from the opposite side of the club face.

20. A set of golf clubs comprising a plurality of golf clubs each comprising:

a club head having:

a club face which constitutes the entire frontal area of the club head with respect to the swing direction;

a generally aerodynamic body extending rearwardly of said club face; and a center of gravity a predetermined distance behind said club face;

a shaft having a shaft axis, said shaft being disposed between the opposite side of the club face and the center of gravity with the shaft axis generally intersecting an imaginary line drawn between the geometric center of the club face and the center of gravity of the club head; and means for moving the center of pressure of the club head during travel of the club in the swing direction rearward of the club face and substantially in-line with the geometric center of the club face and the center of gravity of the club head, said means for moving the center of pressure of the club head comprising a plurality of channels disposed in said body and generally aligned with the direction of air flow over said body during travel of the club in the swing direction, each said channel converging toward the rear of the club head;

wherein a first of said golf clubs has a club face with a predetermined loft angle and wherein each next said golf club has a progressively increasing club face loft angle.

21. A golf club comprising:

a club head having:

a club face which constitutes the entire frontal area of the club head with respect to the swing direction, said club face having a geometric center and being inclined at a predetermined loft angle;

a body extending rearwardly of said club face; and a center of gravity a predetermined distance behind said club face;

a shaft having a shaft axis, said shaft being disposed between the geometric center of the club face and center of gravity such that the axis of the shaft, the geometric center of the club face and the center of gravity lie substantially in the same plane; and means for moving the center of pressure of the club head during travel of the club in the swing direction rearward of the club face and substantially in-line with the geometric center of the club face and the center of gravity of the club head, said means for moving the center of pressure of the club head comprising a plurality of channels disposed in said body and aligned with the direction of air flow over said body during travel of the club in the swing direction, each said channel converging toward the rear of the club head.

22. The golf club as defined in claim 21, wherein said plurality of channels converges toward the rear of the club head.

23. The golf club of claim 21, wherein the center of gravity and the geometric center of the club face lie in a horizontal plane.

24. The golf club of claim 21, wherein the center of gravity is lower than the geometric center of the club face.

25. The golf club of claim 21, wherein the club face is elliptical and a plurality of generally concentric, elliptical grooves are provided in said club face.

26. The golf club of claim 21, wherein an end portion of the shaft is disposed between a pair of diametrically opposed tabs extending from an inner side of said club face, said pair of tabs being positioned such that said shaft extends from said club head at a predetermined lie angle.

27. The golf club of claim 21, wherein two pairs of diametrically opposed tabs extend from an inner side of said club face, said shaft having an end portion disposed between the tabs of one of said pairs, said one of said pairs being selected according to whether a user of the golf club is a right-handed shooter or a left-handed shooter, each said pair of tabs being positioned such that said shaft will extend from said club head at a predetermined lie angle.

28. The golf club of claim 21, wherein the club head is longitudinally symmetrical about a vertical plane which extends through the geometric center of the club face.

29. The golf club of claim 21, wherein the shaft is disposed relative to the club face such that substantially equal areas of the club face extend on either side of the shaft.

30. The golf club of claim 21, wherein the shaft is disposed in a tubular shaft receiving member, said shaft receiving member diagonally abutting the inner side of said club face at an angle corresponding to a predetermined lie angle, said shaft receiving member underlying the geometric center of said club face.

31. The golf club of claim 21, wherein the hitting surface of the club face is slightly convex to facilitate the gear effect.

32. The golf club of claim 21, wherein the width of the club face is equal to or less than the length of the club head in the swing direction.

33. The golf club of claim 21, wherein the club has a bottom surface which is longitudinally convex.

34. The golf club of claim 21, wherein the club has a top surface having at least a portion thereof being longitudinally concave.

35. The golf club of claim 21, wherein said shaft is disposed farther from the enter of gravity than from the opposite side of the club face.

36. A set of golf clubs comprising a plurality of golf clubs each comprising:

a club head having:

a club face which constitutes the entire frontal area of the club head with respect to the swing direction, said club face having a geometric center;

a body extending rearwardly of said club face; and a center of gravity a predetermined distance behind said club face;

a shaft having a shaft axis, said shaft being disposed between the geometric center of the club face and center of gravity such that the axis of the shaft, the geometric center of the club face and the center of gravity lie substantially in the same plane; and means for moving the center of pressure of the club head during travel of the club in the swing direction rearward of the club face and substantially in-line with the geometric center of the club face and the center of gravity of the club head, said means for moving the center of pressure of the club head comprising a plurality of channels disposed in said body and aligned with the direction of air flow over said body during travel of the club in the swing direction, each said channel converging toward the rear of the club head, wherein a first of said golf clubs has a club face with a predetermined loft angle and wherein each next said golf club has a progressively increasing club face loft angle.

37. A golf club comprising:

a club head having:

a club face, said club face being inclined at a predetermined loft angle;

a generally aerodynamic body extending rearwardly of said club face said aerodynamic body comprising:

a forward portion extending rearwardly from said club face said forward portion having substantially the same outer dimensions as the club face; and a rear portion extending rearward of said forward portion said rear portion terminating in a rounded tail, said rear portion including a top surface a bottom surface and side surfaces which converge to said rounded tail; and a center of gravity a predetermined distance behind said club face;

a shaft having a shaft axis, said shaft being disposed between the opposite side of the club face and the center of gravity with the shaft axis generally intersecting an imaginary line drawn between the geometric center of the club face and the center of gravity of the club head;

wherein said top and bottom surfaces are each provided with a plurality of channels extending generally in the direction of air flow over the club head during a swing and wherein each said channel converges in the rearward direction to move the center of pressure of the club during travel in its swing direction further back from the club face.

38. The golf club of claim 37, wherein the shaft is disposed relative to the club face such that substantially equal areas of the club face extend on either side of the shaft.

39. The golf club of claim 37, wherein the club face has an elliptical shape.

40. The golf club of claim 39, wherein a plurality of generally concentric, elliptical grooves are provided in said club face.

41. The golf club of claim 37, wherein the hitting surface of the club face is slightly convex to facilitate the gear effect.

42. The golf club of claim 37, wherein the club face constitutes the entire frontal are of the club head in the swing direction.

43. The golf club of claim 37, wherein the width of the club face is equal to or less than the length of the club head in the swing direction.

44. The golf club of claim 37, wherein the rear portion includes spoiler means for reducing air resistance during swing.

45. The golf club of claim 37, wherein the bottom surface is longitudinally convex.

46. The golf club of claim 37, wherein the top surface is longitudinally concave.

47. The golf club of claim 37, wherein the center of gravity and the geometric center of the club face lie in a horizontal plane.

48. The golf club of claim 37, wherein the center of gravity is lower than the geometric center of the club face.

49. The golf club of claim 37, wherein an end portion of the shaft is disposed between a pair of diametrically opposed tabs extending from an inner side of said club face, said pair of tabs being positioned such that said shaft extends from said club head at a predetermined lie angle.

50. The golf club of claim 37, wherein two pairs of diametrically opposed tabs extend from an inner side of said club face, said shaft having an end portion disposed between the tabs of one of said pairs, said one of said pairs being selected according to whether a user of the golf club is a right-handed shooter or a left-handed shooter, each said pair of tabs being positioned such that said shaft will extend from said club head at a predetermined lie angle.

51. The golf club of claim 37, wherein the shaft is disposed in a tubular shaft receiving member, said shaft receiving member diagonally abutting the inner side of said club face at an angle corresponding to a predetermined lie angle, said shaft receiving member underlying the geometric center of said club face.

52. The golf club of claim 37, wherein the plurality of channels on the top surface converges toward the plurality of channels on the bottom surface.

53. The golf club of claim 37, wherein the channels on the top surface converge toward one another and wherein the channels on the bottom surface converge toward one another.

54. The golf club of claim 37, wherein said shaft axis intersects the imaginary line at a location closer to the opposite side of the club face than to the center of gravity.

55. A club head for a golf club comprising:

a club face which constitutes the entire frontal area of the club head with respect to the swing direction, said club face having a geometric center and being inclined at a predetermined loft angle;

a body extending rearwardly of said club face;

a center of gravity a predetermined distance behind said club face; and means for moving the center of pressure of the club head during travel of the club in the swing direction rearward of the club face and substantially in-line with the geometric center of the club face and the center of gravity of the club head, said means for moving the center of pressure of the club head comprising a plurality of channels disposed in said body and aligned with the direction of air flow over said body during travel of the club in the swing direction, each said channel converging toward the rear of the club head.

56. The club head as defined in claim 55, wherein said plurality of channels converges toward the rear of the club head.

57. The club head of claim 55, wherein two pairs of diametrically opposed tabs extend from an inner side of said club face, each said pair of tabs being positioned such that an end portion of a shaft, if positioned between the tabs of one of said pairs, will enable the shaft to extend from said club head at a predetermined lie, said one of said pairs being selected according to whether a user of the golf club is a right-handed shooter or a left-handed shooter.

58. The club head of claim 57, wherein said end portion of said shaft is positionable between said one of said pairs such that the axis of the shaft intersects an imaginary line between the geometric center of the club face and the center of gravity.

59. The club head of claim 55, wherein an end portion of the shaft is disposed between a pair of diametrically opposed tabs extending from an inner side of said club face, said pair of tabs being positioned such if an end portion of a shaft is positioned between said tabs, said shaft will extend from said club head at a predetermined lie angle.

60. The club head of claim 59, wherein said end portion of said shaft is positionable between said tabs such that the axis of the shaft intersects an imaginary line between the geometric center of the club face and the center of gravity.

61. The club head of claim 55, wherein the hitting surface of the club face is slightly convex to facilitate the gear effect.

62. The club head of claim 55, wherein the width of the club face is equal to or less than the length of the club head in the swing direction.

63. The club head of claim 55, wherein the club face has an elliptical shape.

64. The club head of claim 63, wherein a plurality of generally concentric, elliptical grooves are provided in said club face.

65. A club head for a golf club comprising:

a club face which constitutes the entire frontal area of the club head with respect to the swing direction, said club face having a geometric center and being inclined at a predetermined loft angle;

a body extending rearwardly of said club face;

a center of gravity a predetermined distance behind said club face; and means for moving the center of pressure of the club head during travel of the club in the swing direction rearward of the club face and substantially in-line with the geometric center of the club face and the center of gravity of the club head, said means for moving the center of pressure of the club head comprising a plurality of channels disposed in said body and aligned with the direction of air flow over said body during travel of the club in the swing direction, said plurality of channels converging toward the rear of the club head.

* * * * *